US010407269B1

(12) United States Patent
Tommaso

(10) Patent No.: US 10,407,269 B1
(45) Date of Patent: Sep. 10, 2019

(54) TAPE APPLICATION AND REMOVAL DEVICE

(71) Applicant: Laura Tommaso, Barrington, IL (US)

(72) Inventor: Laura Tommaso, Barrington, IL (US)

( * ) Notice: Subject to any disclaimer, the term of this patent is extended or adjusted under 35 U.S.C. 154(b) by 0 days.

(21) Appl. No.: 16/019,777

(22) Filed: Jun. 27, 2018

(51) Int. Cl.

| | |
|---|---|
| ***B65H 37/02*** | (2006.01) |
| ***B65H 35/00*** | (2006.01) |
| ***B05C 17/02*** | (2006.01) |
| *B65H 37/00* | (2006.01) |

(52) U.S. Cl.
CPC ..... *B65H 35/004* (2013.01); *B05C 17/02* (2013.01); *B65H 35/0033* (2013.01); *B65H 37/007* (2013.01); *B65H 2701/11332* (2013.01)

(58) Field of Classification Search
CPC . B65H 35/0033; B65H 35/007; B65H 37/007
See application file for complete search history.

(56) References Cited

U.S. PATENT DOCUMENTS 1,901,908 A * 3/1933 Hoyos ..... B44D 3/225 156/155
2,468,619 A * 4/1949 Franke ..... B65H 35/0033 156/530
2,999,609 A * 9/1961 Thompson ..... B65H 35/0033 156/527
3,814,643 A * 6/1974 Wagner ..... B65H 35/0033 156/523
4,089,730 A * 5/1978 Mahn ..... B65C 1/025 156/541
4,550,467 A * 11/1985 Johnson ..... A47L 13/29 15/228
4,562,610 A * 1/1986 Davis ..... A63D 5/10 15/228
4,648,935 A * 3/1987 Brown ..... B65H 37/005 156/577
5,269,871 A * 12/1993 Longworth ..... B65H 35/0033 156/527
5,403,430 A * 4/1995 Araujo ..... B44C 7/06 118/501
5,623,740 A 4/1997 Burns
6,735,806 B2 * 5/2004 Blum ..... A47L 13/29 15/104.002
6,925,674 B2 8/2005 Prince
7,028,736 B1 4/2006 Miller
7,340,796 B2 3/2008 Pyles
7,441,581 B2 * 10/2008 Pitzen ..... B65H 35/0033 156/574

(Continued)

*Primary Examiner* — Mark A Osele

(57) ABSTRACT

A tape application and removal device for edge painting includes a frame, a pair of spools, and a roll of tape. Each spool is rotatably coupled to the frame proximate to a respective top corner of the frame. The roll of tape is positioned on one spool with the tape coupled to the other spool so that a section of the tape extends between the spools. The frame is configured to position the spools proximate to an intersection of a first surface and a second surface and to motivate the spools along the intersection so that the tape is applied to the first surface by the one spool and removed by the other spool as the spools are rotated along the first surface. The section of the tape is configured to protect the first surface from paint that is applied to the second surface between the spools.

7 Claims, 5 Drawing Sheets

(56) References Cited

U.S. PATENT DOCUMENTS

| | | | | |
|---|---|---|---|---|
| 8,015,651 | B2 * | 9/2011 | Knopow | B08B 7/0028 15/104.002 |
| 8,413,289 | B1 * | 4/2013 | Dondurur | B05C 17/023 15/230.11 |
| 2002/0194691 | A1 | 12/2002 | Meyer | |
| 2010/0300625 | A1 * | 12/2010 | Hardy | B65H 35/0033 156/527 |
| 2013/0020029 | A1 | 1/2013 | Lazar | |
| 2015/0313443 | A1 * | 11/2015 | Kanai | A47L 11/4047 15/3 |

* cited by examiner

TAPE APPLICATION AND REMOVAL DEVICE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

(2) Description of Related Art Including Information Disclosed Under 37 CFR 1.97 and 1.98

The disclosure and prior art relates to taping devices and more particularly pertains to a new taping device for edge painting.

(h) BRIEF SUMMARY OF THE INVENTION

An embodiment of the disclosure meets the needs presented above by generally comprising a frame, a pair of spools, and a roll of tape. Each spool is rotatably coupled to the frame proximate to a respective top corner of the frame. The roll of tape is positioned on one spool with the tape coupled to the other spool so that a section of the tape extends between the spools. The frame is configured to position the spools proximate to an intersection of a first surface and a second surface and to motivate the spools along the intersection so that the tape is applied to the first surface by the one spool and removed by the other spool as the spools are rotated along the first surface. The section of the tape is configured to protect the first surface from paint that is applied to the second surface between the spools.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
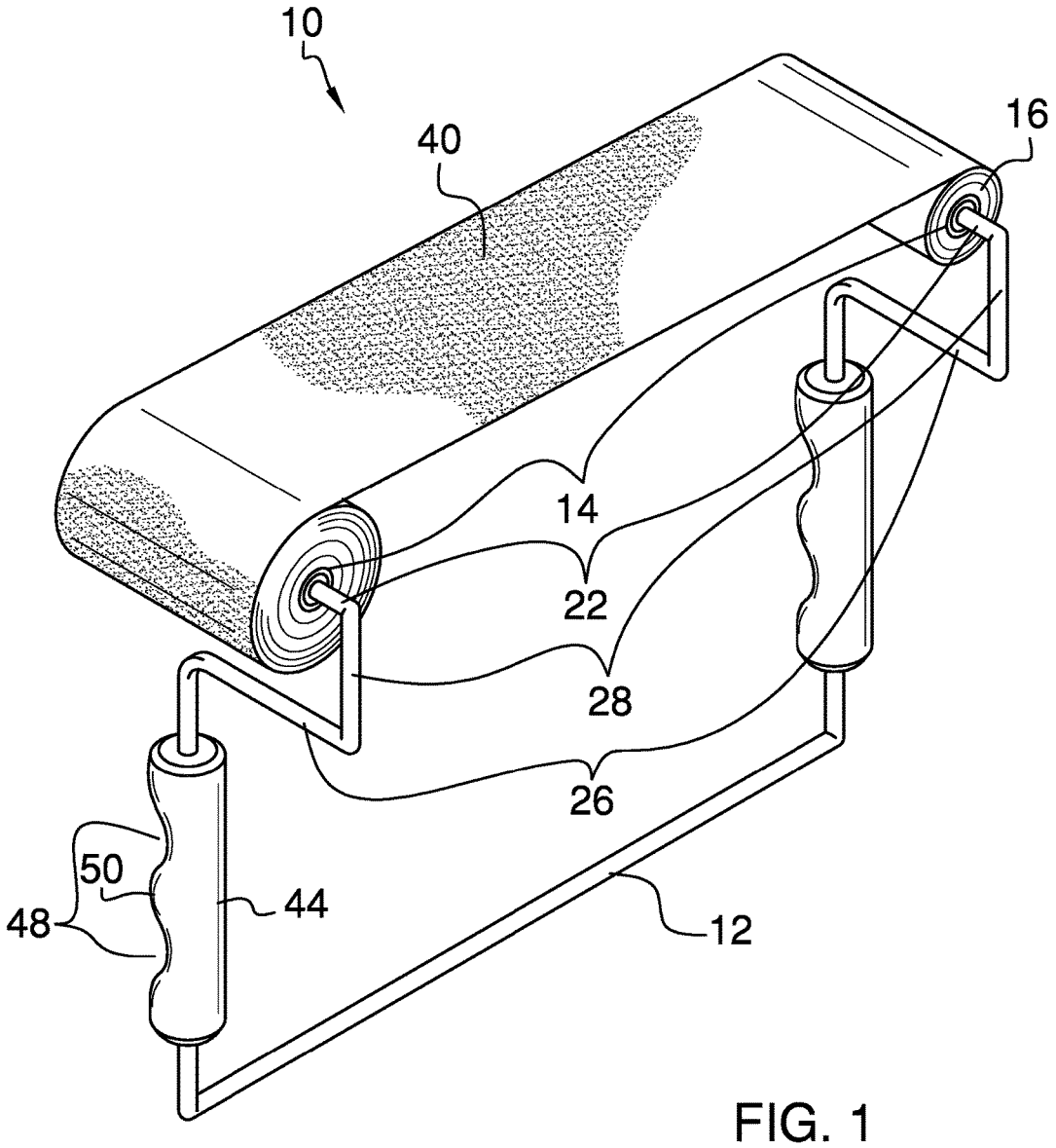
FIG. 1 is an isometric perspective view of a tape application and removal device according to an embodiment of the disclosure.

With reference now to the drawings, and in particular to FIGS. 1 through 5 thereof, a new taping device embodying the principles and concepts of an embodiment of the disclosure and generally designated by the reference numeral 10 will be described.

Figure 2:
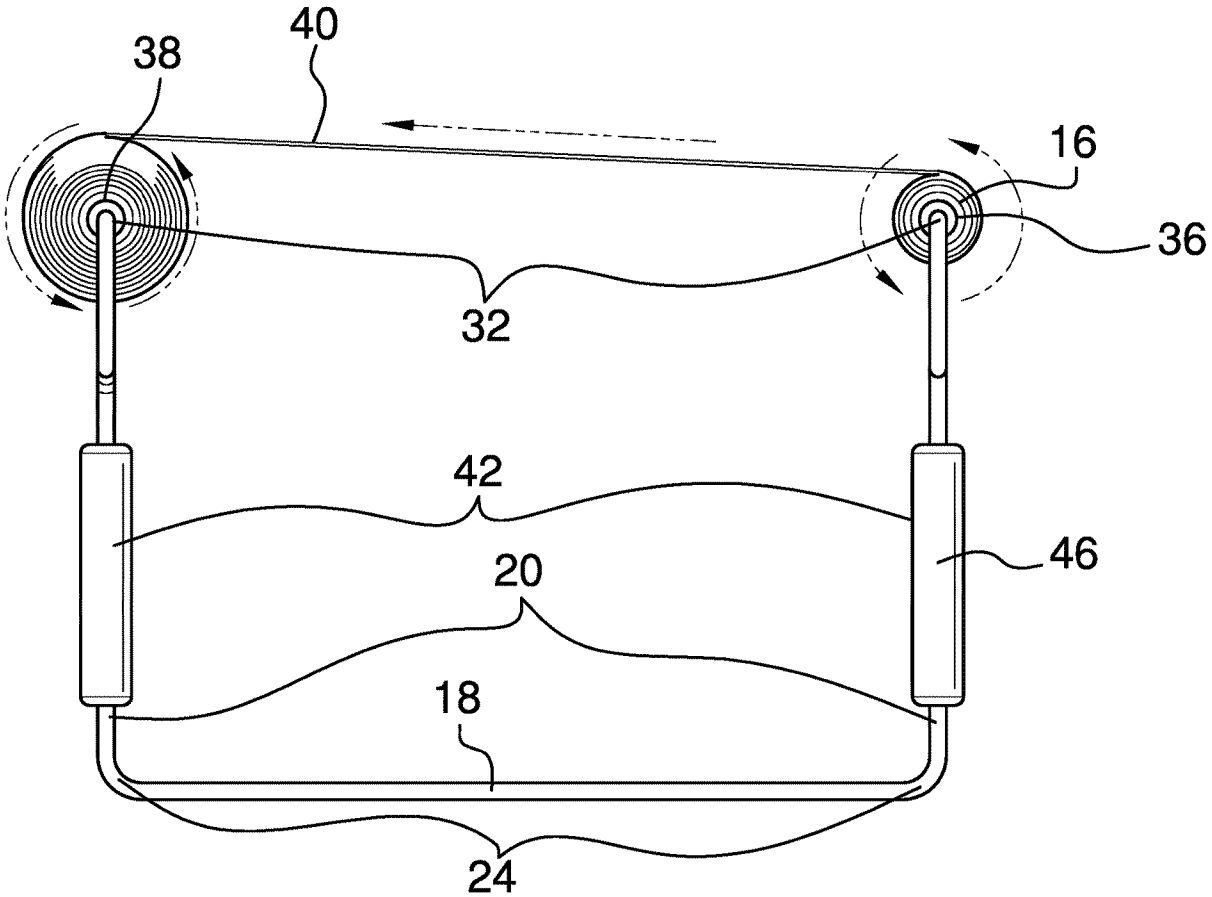
FIG. 2 is a front view of an embodiment of the disclosure.

As best illustrated in FIGS. 1 through 5, the tape application and removal device 10 generally comprises a frame 12, a pair of spools 14, and a roll of tape 16. The frame 12 comprises a first rod 18, a pair of second rods 20, and a pair of spool rods 22. Each second rod 20 is coupled to and extends perpendicularly from a respective opposing terminus 24 of the first rod 18, as shown in FIG. 2. The second rods 20 are coplanar and extend codirectionally from the first rod 18. Each spool rod 22 is coupled to and extends perpendicularly from a respective second rod 20 distal from the first rod 18. The spool rods 22 are coplanar and extend codirectionally from the second rods 20.

Figure 4:
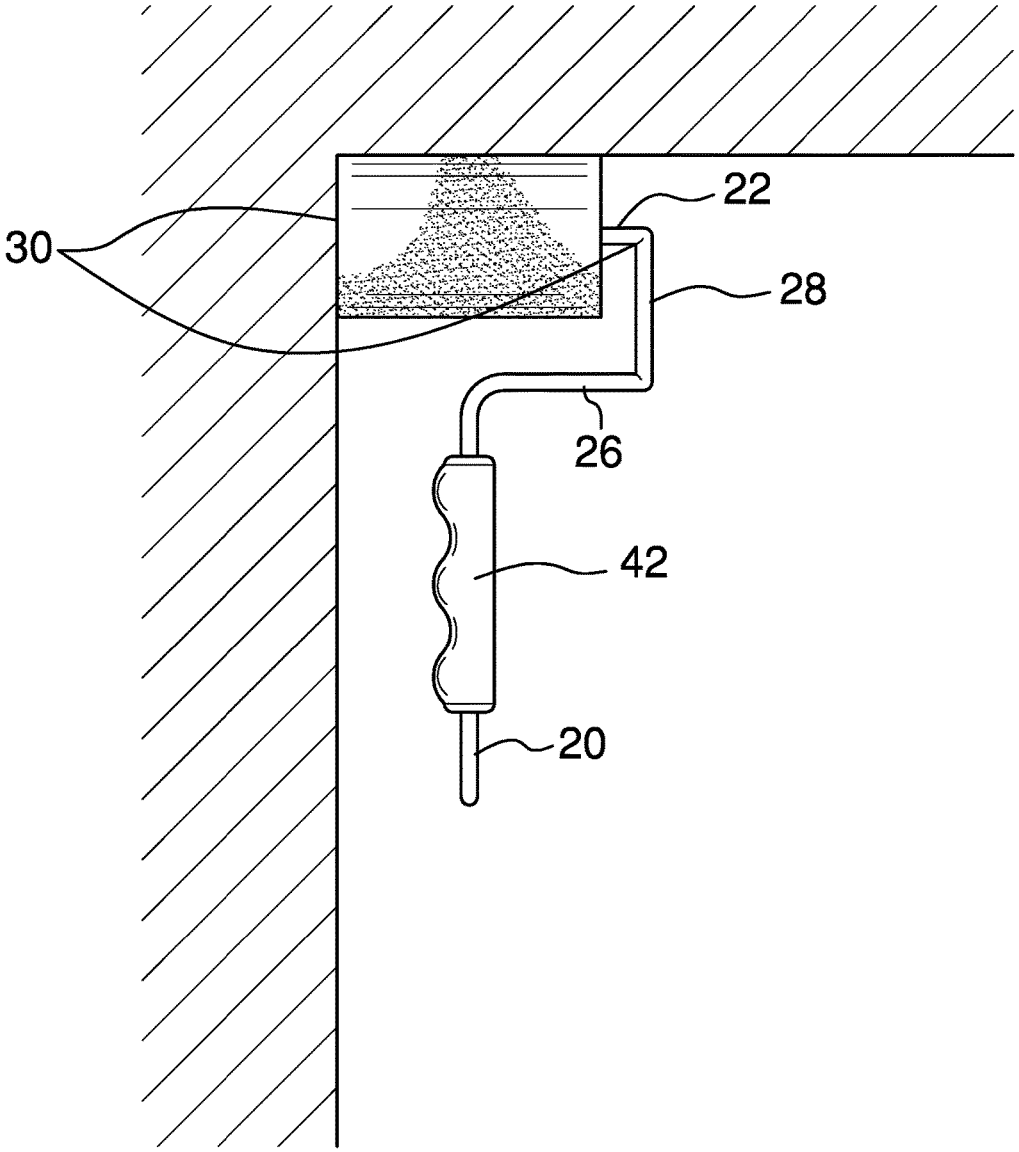
FIG. 4 is an in-use view of an embodiment of the disclosure.
Figure 5:
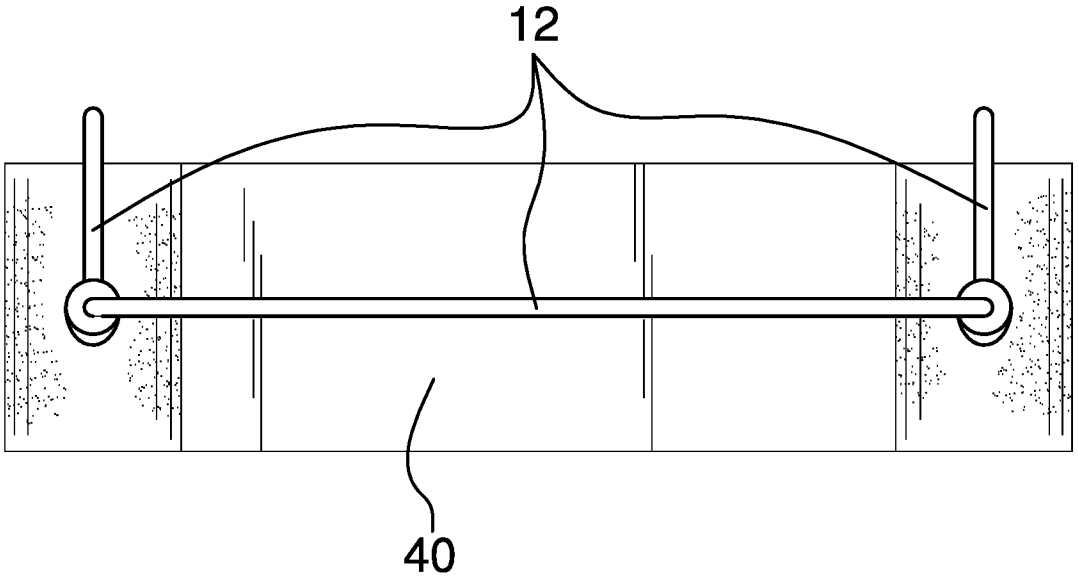
FIG. 5 is a bottom view of an embodiment of the disclosure.

The frame 12 also comprises a pair of third rods 26 and a pair of fourth rods 28, as shown in FIG. 4. Each third rod 26 and an associated fourth rod 28 are positioned between a respective second rod 20 and an associated spool rod 22. The third rod 26 is coupled to and extends perpendicularly from the respective second rod 20 distal from the first rod 18. The third rods 26 are coplanar and extend codirectionally from the second rods 20. The associated fourth rod 28 is coupled to and extends perpendicularly from the third rod 26 distal from the second rod. The fourth rods 28 are coplanar and extend codirectionally from the third rods 26 so that the second rod 20 is perpendicular to the spool rod 22 and positioned substantially equally distant from opposing endpoints 30 of the spool rod 22.

Each spool 14 is rotatably coupled to the frame 12 proximate to a respective top corner 32 of the frame 12, as shown in FIG. 2. The roll of tape 16 is positioned on one of the spools 36. The tape 16 is extended and coupled to the other of the spools 38 so that a section 40 of the tape 16 extends between the spools 14. The frame 12 is configured to position the spools 14 proximate to an intersection of a first surface and a second surface, such as between a wall and a ceiling, as shown in FIG. 4. The section 40 of the tape 16 couples to the first surface and is configured to protect the first surface from paint that is applied to the second surface between the spools 14.

The frame 12 comprises lightweight materials, such as aluminum and plastic, so that the section 40 of the tape 16 couples the frame 12 to the surface, freeing hands of a user to apply the paint. The frame 12 is used to motivate the spools 14 along the intersection so that the tape 16 is applied to the first surface by the one spool 36 and removed by the other spool 38 as the spools 14 are rotated along the first surface.

Figure 3:
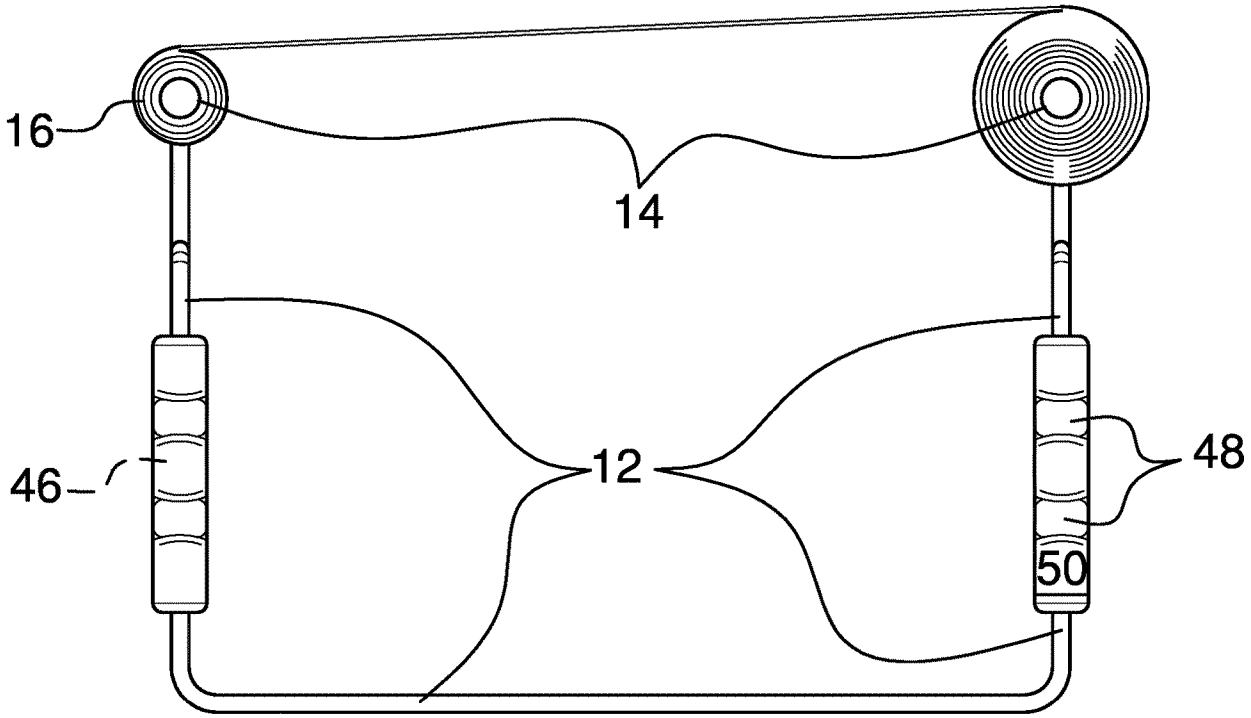
FIG. 3 is a back view of an embodiment of the disclosure.

Each of a pair of handles 42 is coupled to a respective second rod 20, as shown in FIG. 3. The handles 42 are configured to be grasped in the hands of the user to position and motivate the pair of spools 14.

Each handle 42 comprises a cylinder 44. A channel 46 is axially positioned through the cylinder 44. The respective second rod 20 is positioned in the channel 46 and is coupled to the cylinder 44. A plurality of indentations 48 is positioned in a rear face 50 of the cylinder 44. Each indentation 48 is configured to position a respective digit of the hand of the user to enhance a grip of the hand on the cylinder 44. The plurality of indentations 48 comprises two indentations 48. The indentations 48 are arcuate.

In use, the roll of tape 16 is positioned on the one spool 36. The tape 16 is extended and coupled to the other spool 38 so that the section 40 of the tape 16 extends between the spools 14. The frame 12 is grasped by the handles 42, positioning the user to position the spools 14 proximate to the intersection of the first surface and the second surface so that the tape 16 is applied to the first surface by the one spool 36. The section 40 of the tape 16 that is positioned between the spools 14 protects the first surface from the paint that is applied to the second surface between the spools 14. Upon completing the edge painting between the spools 14, the user motivates the spools 14 along the intersection and the tape 16 is removed by the other spool 38, positioning the user to paint the next segment of the intersection of the first surface and the second surface.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tape application and removal device comprising:
a frame;
a pair of spools, each spool being rotatably coupled to the frame proximate to a respective top corner of the frame; and
a roll of tape positioned on one of the spools, the tape being coupled to the other of the spools such that a section of the tape extends between the spools wherein the frame is configured for positioning the pair of spools proximate to an intersection of a first surface and a second surface and for motivating the pair of spools along the intersection such that the tape is applied to the first surface by the one of the spools and removed by the other of the spools as the spools are rotated along the first surface wherein the section of the tape is configured for protecting the first surface from paint being applied to the second surface between the pair of spools; and
the frame comprising:
a first rod,
a pair of second rods, each second rod being coupled to and extending perpendicularly from a respective opposing terminus of the first rod, the second rods being coplanar, the second rods extending codirectionally from the first rod, and
a pair of spool rods, each spool rod being coupled to and extending perpendicularly from a respective second rod distal from the first rod, the spool rods being coplanar, the spool rods extending codirectionally from the second rods.

2. The device of claim 1, further including the frame comprising a pair of third rods and a pair of fourth rods, each third rod and an associated fourth rod being positioned between a respective second rod and an associated spool rod, the third rod being coupled to and extending perpendicularly from the respective second rod distal from the first rod, the third rods being coplanar, the third rods extending codirectionally from the second rods, the associated fourth rod being coupled to and extending perpendicularly from the third rod distal from the second rod, the fourth rods being coplanar, the fourth rods extending codirectionally from the third rods such that the second rod is perpendicular to the spool rod and positioned substantially equally distant from opposing endpoints of the spool rod.

3. The device of claim 1, further including a pair of handles, each handle being coupled to a respective second rod wherein the handles are configured for grasping in hands of a user for positioning and motivating the pair of spools.

4. The device of claim 3, further including each handle comprising:
a cylinder;
a channel axially positioned through the cylinder, the respective second rod being positioned in the channel and coupled to the cylinder; and
a plurality of indentations positioned in a rear face of the cylinder wherein each indentation is configured for positioning a respective digit of the hand of the user for enhancing a grip of the hand on the cylinder.

5. The device of claim 4, further including the plurality of indentations comprising two indentations.

6. The device of claim 4, further including the indentations being arcuate.

7. A tape application and removal device comprising:
a frame, the frame comprising:
a first rod,
a pair of second rods, each second rod being coupled to and extending perpendicularly from a respective opposing terminus of the first rod, the second rods being coplanar, the second rods extending codirectionally from the first rod, a pair of spool rods, each spool rod being coupled to and extending perpendicularly from a respective second rod distal from the first rod, the spool rods being coplanar, the spool rods extending codirectionally from the second rods, and a pair of third rods and a pair of fourth rods, each third rod and an associated fourth rod being positioned between a respective second rod and an associated spool rod, the third rod being coupled to and extending perpendicularly from the respective second rod distal from the first rod, the third rods being coplanar, the third rods extending codirectionally from the second rods, the associated fourth rod being coupled to and extending perpendicularly from the third rod distal from the second rod, the fourth rods being coplanar, the fourth rods extending codirectionally from the third rods such that the second rod is perpendicular to the spool rod and positioned substantially equally distant from opposing endpoints of the spool rod;

a pair of spools, each spool being rotatably coupled to the frame proximate to a respective top corner of the frame;

a roll of tape positioned on one of the spools, the tape being coupled to the other of the spools such that a section of the tape extends between the spools wherein the frame is configured for positioning the pair of spools proximate to an intersection of a first surface and a second surface and for motivating the pair of spools along the intersection such that the tape is applied to the first surface by the one of the spools and removed by the other of the spools as the spools are rotated along the first surface wherein the section of the tape is configured for protecting the first surface from paint being applied to the second surface between the pair of spools; and a pair of handles, each handle being coupled to a respective second rod wherein the handles are configured for grasping in hands of a user for positioning and motivating the pair of spools, each handle comprising:

a cylinder, a channel axially positioned through the cylinder, the respective second rod being positioned in the channel and coupled to the cylinder, and a plurality of indentations positioned in a rear face of the cylinder wherein each indentation is configured for positioning a respective digit of the hand of the user for enhancing a grip of the hand on the cylinder, the plurality of indentations comprising two indentations, the indentations being arcuate.

* * * * *